United States Patent [19]

Yamane et al.

[11] Patent Number: 4,917,836

[45] Date of Patent: Apr. 17, 1990

[54] PROCESS FOR PRODUCING HIGH-STRENGTH, HIGH-MODULUS CARBON FIBERS

[75] Inventors: Shoji Yamane; Tomitake Higuchi; Katsumi Yamasaka, all of Ehime, Japan

[73] Assignee: Toray Industries, Inc., Tokyo, Japan

[21] Appl. No.: 265,341

[22] Filed: Oct. 27, 1988

Related U.S. Application Data

[63] Continuation of Ser. No. 929,466, Nov. 12, 1986, abandoned.

[30] Foreign Application Priority Data

Nov. 18, 1985 [JP] Japan ..... 60-256730
Nov. 18, 1985 [JP] Japan ..... 60-256731

[51] Int. Cl.[4] ..... D01F 6/18; D01F 9/22

[52] U.S. Cl. ..... 264/29.2; 264/29.6; 264/29.7; 264/41; 264/83; 264/130; 264/136; 264/182; 264/206; 264/210.2; 264/210.3; 264/210.4; 264/210.7; 264/210.8; 264/211.15; 264/211.16; 264/288.8

[58] Field of Search ..... 264/29.2, 182, 129, 264/206, 210.2, 210.3, 210.8, 29.7, 29.6, 41, 83, 130, 136, 210.4, 210.7, 211.15, 211.16, 288.8; 423/447.4, 447.6

[56] References Cited

U.S. PATENT DOCUMENTS 2,957,748 10/1960 Lieseberg ..... 264/182

FOREIGN PATENT DOCUMENTS 0159365 10/1985 European Pat. Off. .
53-45425 4/1978 Japan ..... 264/29.2
53-139824 12/1978 Japan ..... 264/29.2
54-131032 10/1979 Japan ..... 264/29.2
55-163217 12/1980 Japan .
58-136838 8/1983 Japan ..... 264/29.2
58-214517 12/1983 Japan ..... 264/29.2
59-137512 8/1984 Japan ..... 264/29.2
61-146817 7/1986 Japan ..... 264/29.2

*Primary Examiner*—Hubert C. Lorin
*Attorney, Agent, or Firm*—Armstrong, Nikaido, Marmelstein, Kubovcik & Murray

[57] ABSTRACT

A process of producing carbon fibers, which comprises oxidizing polyacrylonitrile filaments having a tensile strength at 240° C. of 0.3 g/d or higher and a tensile modulus at 240° C. of 2.0 g/d or higher in an oxidizing atmosphere under a high tension of 0.2 g/d or higher, and carbonizing the oxidized filaments under a high tension.

5 Claims, No Drawings

PROCESS FOR PRODUCING HIGH-STRENGTH, HIGH-MODULUS CARBON FIBERS

This application is a continuation of application Ser. No. 929,466 filed Nov. 12, 1986, now abandoned.

BACKGROUND

Carbon fibers have been widely used as a structural material in the form of a composite thereof with a matrix material such as a resin or a metal. Since carbon fibers have excellent mechanical, thermal, electrical and antimicrobial properties, they are used as reinforcing fibers for structural members of aerospace vehicles such as crafts, rockets, etc., as well as structural members of sporting goods such as golf club shafts, tennis rackets, fishing rods, etc. A generally adopted process for producing such carbon fibers comprises heating acrylic fibers as the raw material (precursor) in an oxidizing atmosphere of about 200° to 300° C. to convert the precursors into oxidized fibers, and subsequently heating the oxidized fibers in an atmosphere of at least about 1,000° C. to carbonize the same.

Investigations have recently been made on the use of carbon fibers in the fields where a higher performance is required, for example, in primary structural members of aircrafts, which use may be attained by further improving the performance, particularly the tensile strength, of carbon fibers while keeping the modulus of elasticity thereof on a high level. Thus, there has been a growing demand for higher quality and performance of carbon fibers. Many proposals have heretofore been made with a view to coping with such demand. However, the proposed processes have achieved an increase or improvement in tensile strength but no increase or improvement in modulus. Most of the proposed processes involve a problem that the tensile strength is lowered when an enhancement of or an improvement in the tensile modulus is intended. For example, as one of those proposals, Japanese patent application Kokai publication No. 55-163217 discloses a process of producing carbon fibers of a high performance which uses an acrylic precursor obtained by a dry-jet wet spinning and a multi-stage drawing. However, this Japanese publication does not disclose oxidation and carbonization steps operated under a very high tension. On the other hand, European application publication No. 0159365 Al discloses oxidation and carbonization steps operated under a very high tension, but does not disclose a dry-jet wet spinning and a multi-stage drawing.

SUMMARY

An object of the present invention is to provide a process for producing high-strength, high-modulus carbon fibers which are improved in both of tensile strength and tensile modulus and have highly balanced values of properties.

Another object of the present invention is to provide a process for producing high-strength, high-modulus carbon fibers having a high quality of being free from filament breakage and fluffing.

According to the present invention, there are obtained high-strength, high-modulus carbon fibers having a strand tensile strength of at least 580 kg/mm$^2$, a strand tensile modulus of 29 tons/mm$^2$ or higher, and a degree of X-ray crystallographic orientation of 82%, and satisfying the following formula concerning the degree of orientation and the X-ray crystallographic perfectness:

$$\pi(002)-93.0+B(002)\times 2.0>0.$$

A remarkable feature of the process for producing carbon fibers according to the present invention consists in the use of an acrylic fiber precursor containing 99 wt. % or more of acrylonitrile units and having a tensile strength at 240° C. of at least 0.3 g/d and a tensile modulus at 240° C. of 2.0 g/d or higher. Such acrylic precursor is oxidized under a tension of 0.2 g/d or higher, preferably 0.2 to 0.8 g/d at a temperature within the range of 200° to 300° C. The resulting oxidized fibers are then heated under a high tension of 0.03 to 0.1 g/d in an inert atmosphere at a temperature within the range of 300° to 900° C. to effect a preliminary carbonization. The fibers are further heated under a high tension of 0.2 to 0.8 g/d in an inert atmosphere maintained at a temperature of 1,000° to 1,500° C. to complete carbonization.

The tension mentioned here is calculated on the basis of the size of fibers before the oxidation and carbonization reactions.

DETAILED DESCRIPTION OF THE INVENTION

When the tensile strength at 240° C. of an acrylic precursor to be used in the present invention is lower than 0.3 g/d, a difficulty is encountered in oxidizing the precursor under a high tension. When the tensile modulus at 240° C. is lower than 2.0 g/d, heating of the precursor under a high tension within the abovementioned range in the steps of oxidation and carbonization becomes impossible. As a result, the high-strength, high-modulus carbon fibers according to the present invention cannot be obtained.

A tensile strength of 0.3 g/d or higher and a tensile modulus of 2.0 g/d or higher at 240° C. are indispensable requisites for the precursor to reflect the influence of a high tension of the fiber during the oxidation and carbonization stages on an improvement in the quality of carbon fibers. When the precursor satisfies these requisites, it will become possible for the first time to produce high-strength, high-modulus carbon fibers having a high degree of X-ray crystallographic orientation and X-ray crystallographic perfectness as aimed at by the present invention.

In a process for preparing an acrylic fiber precursor satisfying the above-described requisites of tensile strength and tensile modulus at 240° C., acrylonitrile and at least one comonomer preferably selected from the group consisting of acrylic acid, methacrylic acid, itaconic acid, and alkaline metal or ammonium salts and amide compounds thereof are used to form an acrylonitrile copolymer composed of 99 wt. % or more of acrylonitrile units and 1 wt. % or less of comonomer units.

The acrylonitrile polymer should have an intrinsic viscosity of 1.3 to 3.0, preferably 1.5 to 2.0. Useful solvents for preparing a dope of the acrylonitrile copolymer include organic solvents such as dimethyl sulfoxide (DMSO), dimethylacetamide (DMAc), and dimethylformamide (DMF); and inorganic solvents such as aqueous solutions of nitric acid, zinc chloride, or sodium rhodanide, though the kind of the solvent is not particularly limited thereto.

As for the spinning process, a dry-jet wet spinning has to be employed. The process comprising first extruding a dope or spinning solution of an acrylonitrile polymer solution through a spinneret into an inert atmosphere and then introducing the extrudate into a coagulating bath. The resulting swollen fibers contain voids, of which the diameter is smaller than that of conventional fibers, are drawn in multiple steps at a temperature of 100° C. or higher to finally provide an overall draw ratio of 7 or higher, preferably 9 or higher, whereby the void size of the swollen fiber is decreased to 100 Å or smaller. The degree of orientation of the resulting drawn filaments, as expressed by $\pi(400)$, is preferably 92% or higher.

Where comonomers other than acrylic acid, methacrylic acid, itaconic acid, and alkaline metal or ammonium salts and amide compounds thereof are used, and where comonomers selected from the group consisting of acrylic acid, methacrylic acid, itaconic acid, and alkaline metal or ammonium salts and amide compounds thereof are used in an amount exceeding 1 wt. %, the hydrophilicity or plasticity or both of the resulting acrylic fibers are increased, with the result that no acrylic fiber satisfying the above-mentioned requisites of the tensile strength and tensile modulus at 240° C. cannot be obtained. In other words, the kind and the amount of comonomer as in the above-mentioned cases weaken the intermolecular force between the polymer chains constituting the fiber and reduce the structure perfectness of the fiber from the viewpoint of the resulting fiber structure, thus causing deterioration in the properties of the acrylic precursor at a high temperature of 240° C.

When the mean size of voids in the swollen acrylic fibers directly before collapsing obtained by dry-jet wet spinning exceeds 100 Å, not only are voids constituting a structural defect of the resulting carbon fiber formed but also the fibril structure of the precursor remains in the crosssection of the carbon fiber. In other words, the fiber structure of the swollen fiber before collapsing is reflected as such in the structure of the carbon fiber. Thus, a decrease in the void size is very important in attaining the objects of the present invention.

The conditions for obtaining swollen fibers having the mean size of voids less than 100 Å are multistep drawing in at least two steps, preferably 4 to 6 steps, and an overall draw ratio of at least 7, preferably 9 or more.

Instances of multistep drawing include a process wherein drawing is effected using drawing baths consisting of water or an aqueous solution of a solvent common with a spinning solution while keeping the drawing baths at successively elevated temperatures. More specifically, there can be mentioned a process wherein drawing is effected using first to fourth drawing baths of a dimethyl sulfoxide (DMSO)-water system having a DMSO concentration of lower than 5% at draw ratios in the first to fourth drawing baths of 1.33, 1.33, 1.20, and 1.20, respectively, to provide an overall draw ratio of about 2.55 and maintained at temperatures of 30° C., 35° C., 40° C. and 50° C., respectively.

The fineness of filaments of the precursor to be used in the present invention may be about 0.1 to 3 d, preferably 0.1 to 0.8 d. The total number of filaments can be arbitrarily chosen within a range of 500 to 30,000.

In order to have the structure perfectness of the acrylic precursor in the raw yarn state reflected on that of carbon fiber bundles as much as possible, it is important to apply a tension of 0.2 g/d or higher preferably 0.2 to 0.8 g/d, in conversion of the precursor into the oxidized fiber. Where the tension applied to the precursor in this conversion is below the above-mentioned value, relaxation of the fiber structure occurs to merely form oxidized fibers having a poor degree of orientation no matter how high the structure perfectness of the precursor may be. As a result, only carbon fibers having poor strength characteristics are obtained.

In carbonization of the oxidized fibers having a high degree of orientation, it is necessary that the oxidized fibers be heated under a high tension of about 0.05 to 0.1 g/d in an inert atmosphere within a range of 300° to 900° C., and subsequently heated under a tension of about 0.2 to 0.8 g/d in an inert atmosphere maintained at a temperature as low as possible, namely at a temperature usually of 1,000° to 1,500° C., preferably 1,450° C. or lower, to complete carbonization.

The resulting carbon fibers according to the present invention characteristically have a strand tensile strength of 580 kg/mm$^2$ or higher and a strand tensile modulus of 29 tons/mm$^2$ or higher. The degree of X-ray crystallographic orientation as expressed by $\pi(002)$ is characteristically at least 82% or more. The following formula (I) is characteristically positive:

$$\pi(002) - 93.0 + B(002) \times 2.0 \quad \text{(I).}$$

wherein the degree of X-ray crystallographic orientation, $\pi(002)$, is a yardstick showing the degree of orientation in the fiber axis of graphite crystals constituting the carbon fibers, and the X-ray crystallographic perfectness, B(002), is a yardstick showing the degree of growth of graphite crystals.

Since the carbon fibers according to the present invention are obtained by carbonization under a high tension of acrylic fibers having a high structure perfectness as the raw material precursor, it is characterized in that it has undergone no relaxation of the fiber structure during the carbonization. Therefore, the carbon fibers according to the present invention have a high degree of orientation, a positive value of the formula (I), as compared with conventional carbon fibers obtained at the same carbonization temperature. It has an extremely excellent mechanical properties including a strand tensile strength of 580 kg/mm$^2$ or higher and a strand tensile modulus of 29 tons/mm$^2$ or higher.

Further, the carbon fibers according to the present invention have a high grade and a high quality since it is considerably free from fluff, scratches, and cracks.

The following Examples will now specifically illustrate the present invention. The degree of X-ray crystallographic orientation, the X-ray crystallographic perfectness, the mean void size, the tensile strength and tensile modulus of a precursor at a high temperature, the strand tensile strength, and the strand tensile modulus as mentioned in the present invention are respectively measured by the following methods.

(1) Degree of X-ray crystallographic orientation 20 mg/4 cm of a sample is bound with collodion in a mold having a width of 1 mm in preparation for a measurement. The measurement is made using as the X-ray source a $K_{60}$ line (wavelength: 1.5418 A) of Cu made monochromatic with a Ni filter at an output of 35 kV and 15 mA. In the case of a precursor, a half-value width H (°) of a peak is obtained by scanning a peak of Miller indices (400) observed around $2\theta = 17.0°$ in the circumferential direction. The degree of orientation, $\pi$%, is calculated from the half-value width according to the following equation:

$\pi = (180 - H)/180\ (\%)$.

A goniometer having a slit of 2 mmϕ and a scintillation counter are used. The scanning speed is 4°/min and the time constant is 1 sec, while the chart speed is 1 cm/min. In the case of a carbon fiber, the degree of orientation, $\pi\%$, is calculated from a halfvalue width H (°) of a peak obtained by scanning a peak of Miller indices (002) observed around $2\theta = 25.5°$ in the circumferential direction according to the above-mentioned equation. The scanning speed is 8°/min.

(2) X-ray crystallographic perfectness

The half-value width H (°) of a peak obtained by scanning a peak of Miller indices (002) measured in the same manner as in the measurement of the degree of X-ray crystallographic orientation, $\pi$, in the equatorial direction is defined as B(002).

(3) Mean void size

Filaments are sufficiently washed and stripped of water containing on the surfaces thereof by a centrifugal separator (3000 rpm × 15 min). Thereafter, about 5 mg of the filaments are placed in a closed sample vessel. The melting point of water present in the voids of the sample was measured by a differential scanning calorimeter (DSC), which is operated from −60° C. to ambient temperature. The mean void size is calculated from the value of a peak appearing at a temperature of 0° C. or lower according to the following equation. The temperature rise speed is 2.5° C./min. Pure water is used for temperature correction, while indium is used for calory correction.

void size = 164/[melting point] (° C.)

(4) Measurement of tensile strength and tensile modulus at high temperature of precursor A filament is introduced into an air heating furnace (effective furnace length: 2.6 m) set at 240° C. at a speed of 1 m/min. The tension and elongation in the introduction are measured to find the tensile strength and the tensile modulus. The tensile modulus is calculated from the gradient of the most highly inclined line of the stress-elongation curve.

(5) Strand tensile strength and strand tensile modulus

The tensile strength and tensile modulus of strands impregnated with an epoxy resin are measured in accordance with the measurement method stipulated in JIS-R-7601. The average value of 10 measurement runs is shown.

EXAMPLE 1

A 20% DMSO solution of an acrylonitrile copolymer composed of 99 wt. % of acrylonitrile units and 1 wt. % of methacrylic acid units (solution viscosity at 45° C.: 600 poises) was subjected to dry-jet wet spinning extruding into air through a spinneret having a hole diameter of 0.1 mm and the number of holes of 1,500 under 5 levels of conditions Nos. 1 to 5 as listed in Table 1. Coagulation was made by introducing spun filaments into a 30% aqueous DMSO solution, followed by withdrawal of the resulting coagulated filaments from the bath. The coagulated filaments were washed with water by the customary method, and drawn in three-step water baths of 30° C., 40° C., and 50° C., followed by furnishing thereto with a heat-resistant silicone oil. The resulting filaments were dried to collapse the same, and further drawn in steam to provide an overall draw ratio of 12. Thus, precursors having a filament fineness of 0.7 d were prepared. Filaments prepared under the conditions No. 1 were broken in steam drawing, resulting in a failure of drawing at an overall draw ratio of 12.

The obtained precursors Nos. 2 to 5 were respectively heated under a tension of 0.24 g/d in air having a temperature gradient in a range of 245° to 275° C. to be converted into oxidized filaments, which were finally heated in an inert atmosphere heated up to 1,350° C. to obtain carbon fibers having properties as listed in Table 1.

In the cases of the precursors Nos. 2, 3, and 5 in Table 1, the mean void size of filaments before drying was smaller than 100 Å, and the tensile strength and tensile modulus at a high temperature were enough to satisfy the requirements specified in the present invention. The carbon fibers obtained from these precursors had excellent tensile strength and tensile modulus.

In contrast, the precursor No. 4 had to void size of larger than 100 Å, and did not satisfy the draw ratio, the tensile strength and tensile elasticity at a high temperature, etc. as specified in the present invention. The carbon fiber obtained from this precursor was found to have poor mechanical properties.

For the purpose of comparison, substantially the same procedure of spinning as in the case of the precursor No. 3 except that in-bath drawing was done only in one step using a bath of 50° C. was repeated to find that the mean void size of filaments before drying for collapsing was about 20 Å but the spinability of the filaments was so poor that only a very fluffy precursor can be obtained at a draw ratio of about 12.

TABLE 1

| No. | 1 | 2 | 3 | 4 | 5 |
|---|---|---|---|---|---|
| Dope Temperature (°C.) | 35 | 35 | 35 | 50 | 35 |
| Coagulation Bath Temperature (°C.) | 5 | 5 | 5 | 25 | 30 |
| Draw Ratio | 2 | 3 | 4 | 4 | 3 |
| Mean Void Size (Å) | 100 | 30 | 25 | 150 | 90 |
| Degree of Orientation (%) | — | 92.4 | 92.5 | 89.8 | 92.1 |
| Tensile Strength at 240° C. (g/d) | — | 0.35 | 0.35 | 0.27 | 0.33 |
| Tensile Modulus at 240° C. (g/d) | — | 3.0 | 2.8 | 1.5 | 2.1 |
| Tensile Strength of Carbon Fibers ($Kg/mm^2$) | — | 580 | 580 | 520 | 560 |
| Tensile Modulus of Carbon Fibers ($ton/mm^2$) | — | 29.5 | 29.7 | 28.3 | 29.0 |

EXAMPLE 2

A 20% DMSO solution of an acrylonitrile copolymer composed of 99.3 wt. % of acrylonitrile units and 0.7 wt. % of itaconic acid units (solution viscosity at 45° C.: 700 poises) was first extruded into an air atmosphere through a spinneret having a hole diameter of 0.1 mm and the number of holes of 3,000 at a temperature of 35° C., and then introduced into a 30% aqueous DMSO solution of 5° C. to effect coagulation, followed by withdrawal of the resulting coagulated filaments from the bath. The coagulated filaments were washed with water by the customary method, and drawn in five-step drawing baths providing a temperature gradient ranging from 30° C. to 50° C., followed by furnishing with oil. The resulting filaments were dried to collapse the same, and further drawn in steam to provide varied overall draw ratios as listed in Table 2. Thus, precursors Nos. 6, 7, and 8 having a filament fineness of 0.7 d were prepared.

The precursors Nos. 6, 7, and 8 were oxidized and carbonized under the same conditions as in Example 1 to prepare carbon fibers having mechanical properties as listed in Table 2.

COMPARATIVE EXAMPLE 1

A spinning solution was directly introduced through a spinneret having a hole diameter of 0.05 mm into a 30% aqueous DMSO solution without extruding into an air atmosphere, while following substantially the same procedure as in Example 2. In this procedure, when the temperature of the coagulation bath was set at 5° C., filaments were broken. Accordingly, the temperature of the coagulation bath was changed to 45° C. The spinning was done with the other conditions being the same as in Example 2. The overall draw ratio was varied in steam drawing to those as listed in Table 2. Thus, precursors Nos. 9, 10, and 11 having a filament fineness of 0.7 d were prepared.

The precursors Nos. 9, 10, and 11 were oxidized and carbonized under the same conditions as in Example 1 to prepare carbon fibers having mechanical properties as listed in Table 2.

TABLE 2

| No. | 6 | 7 | 8 | 9 | 10 | 11 |
|---|---|---|---|---|---|---|
| Spinning Method | dry-jet wet process | dry-jet wet process | dry-jet wet process | wet process | wet process | wet process |
| Overall Draw Ratio | 6.0 | 9.0 | 12.0 | 6.0 | 9.0 | 12.0 |
| Mean Void Size (Å) | 30 | 30 | 30 | 140 | 140 | 140 |
| Degree of Orientation (%) | 84.5 | 92.1 | 92.5 | 84.0 | 88.6 | 90.8 |
| Tensile Strength | 0.20 | 0.30 | 0.38 | 0.15 | 0.20 | 0.27 |

TABLE 2-continued

| No. | 6 | 7 | 8 | 9 | 10 | 11 |
|---|---|---|---|---|---|---|
| at 240° C. (g/d) | | | | | | |
| Tensile Modulus at 240° C. (g/d) | 1.3 | 2.0 | 3.0 | 0.8 | 1.0 | 1.4 |
| Tensile Strength of Carbon Fibers (Kg/mm$^2$) | 510 | 580 | 590 | 510 | 530 | 560 |
| Tensile Modulus of Carbon Fibers (ton/mm$^2$) | 27.0 | 29.0 | 29.7 | 23.5 | 25.0 | 26.0 |

EXAMPLE 3

Spinning was done using acrylonitrile copolymers having varied itaconic acid unit contents under substantially the same conditions as in the preparation of the precursor No. 7 in Example 2. The tensile strength and tensile modulus at a high temperature (240° C.) of the resulting precursors are listed in Table 3.

TABLE 3

| Comonomer wt. % | Properties at 240° C. Tensile Strength (g/d) | Tensile Modulus (g/d) |
|---|---|---|
| 0.3 | 0.40 | 2.9 |
| 0.7 | 0.38 | 3.0 |
| 1.0 | 0.32 | 2.0 |
| 1.5 | 0.27 | 1.8 |

EXAMPLE 4

A 20% DMSO solution of an acrylonitrile copolymer composed of 99.3 wt. % of acrylonitrile units and 0.7 wt. % itaconic acid units (solution viscosity at 45° C.: 700 poises) was first extruded into an air atmosphere through a spinneret having a hole diameter of 0.1 mm and the number of holes of 3,000 at a temperature of 35° C., and then introduced into a 30% aqueous DMSO solution to effect coagulation, followed by withdrawal of the resulting coagulated filaments from the bath. The coagulated filaments were washed with water by the customary method, and drawn in a water bath having a temperature gradient ranging from 30° C. to 60° C., followed by furnishing thereto with a silicone oil. The resulting filaments were dried to collapse the same, and further drawn in steam to provide an overall draw ratio of 12. Thus, five kinds of precursors Nos. 12 to 16 as shown in Table 4 which have a filament fineness of 0.7 d were prepared.

The precursors Nos. 12 to 16 were oxidized and carbonized under conditions as listed in Table 4 to prepare carbon fibers having mechanical properties as listed in Table 4.

TABLE 4

| No | Spinning Method | Properties at 240° C. Tensile Strength (g/d) | Tensile Modulus (g/d) | Tension in Oxidation Step (g/d) | Carbonization Temperature (°C.) | B (002) (°) | Properties of Carbonized Filaments π (002) (%) | Tensile Strength (kg/mm$^2$) | Tensile Modulus (ton/mm$^2$) | Value of the left-side term of formula (I) |
|---|---|---|---|---|---|---|---|---|---|---|
| 12 | dry-jet wet | 0.38 | 2.5 | 0.35 | 1350 | 5.40 | 82.8 | 595 | 30.2 | 0.6 |

TABLE 4-continued

| No | Spinning Method | Properties at 240° C. Tensile Strength (g/d) | Tensile Modulus (g/d) | Tension in Oxidation Step (g/d) | Carbonization Temperature (°C.) | B (002) (°) | Properties of Carbonized Filaments π (002) (%) | Tensile Strength (kg/mm²) | Tensile Modulus (ton/mm²) | Value of the left-side term of formula (I) |
|---|---|---|---|---|---|---|---|---|---|---|
| 13 | process dry-jet wet | " | " | 0.24 | 1250 | 5.65 | 82.3 | 580 | 29.2 | 0.7 |
| 14 | process dry-jet wet | " | " | " | 1350 | 5.36 | 82.4 | 585 | 29.5 | 0.1 |
| 15 | process dry-jet wet | " | " | " | 1450 | 4.90 | 84.4 | 580 | 30.1 | 1.2 |
| 16 | process dry-jet wet | " | " | 0.16 | 1350 | 5.30 | 81.5 | 560 | 28.2 | −0.9 |
| 17 | process wet | 0.27 | 1.4 | 0.35 | | yarn breakage | | — | — | |
| 18 | process wet | " | " | 0.24 | 1250 | 5.60 | 81.3 | 550 | 27.9 | −0.5 |
| 19 | process wet | " | " | " | 1350 | 5.35 | 81.1 | 560 | 28.3 | −0.6 |
| 20 | process wet | " | " | " | 1450 | 4.90 | 82.0 | 555 | 29.4 | −1.2 |
| 21 | process wet | " | " | 0.16 | 1350 | 5.30 | 80.8 | 560 | 28.8 | −1.6 |
| | process | | | | | | | | | |

COMPARATIVE EXAMPLE 2

As in Example 3, substantially the same procedure as in Example 1 except that a dope of 35° C. was directly extruded through a spinneret having a hole diameter of 0.05 mm into a 30% aqueous DMSO solution, was repeated to obtain precursors Nos. 17 to 21 showing mechanical properties at a high temperature (240° C.) as listed in Table 4. The precursors Nos. 17 to 21 were respectively oxidized and carbonized under conditions of oxidation tension and carbonization temperature as listed in Table 4 to prepare carbon fibers having mechanical properties as listed in Table 4.

We claim:

1. A process for producing carbon fibers, comprising the steps of first extruding a solution of an acrylonitrile polymer comprising 99 wt. % or more of acrylonitrile units through a spinneret provided over the liquid surface of a coagulating bath into an inert atmosphere; then introducing the resultant filaments into said coagulating bath to effect coagulation for formation of swollen filaments having therein voids; then drawing said swollen filaments in at least two drawing baths which have successively elevated temperatures to provide a mean void size in filaments of 100 Å or smaller; applying an oil to the multistep drawn filaments; drying the oil-applied filaments to collapse the same; further drawing the collapsed filaments at a temperature of 100° C. or higher to provide an overall draw ratio, including a draw ratio in said multistep drawing, of at least 7 for formation of drawn filaments having a tensile strength at 240° C. of 0.3 g/d or higher and a tensile modulus at 240° C. of 2.0 g/d or higher; heating said drawn filaments in an oxidizing atmosphere of 200° to 300° C. under tension of 0.2 g/d or higher to convert the same into oxidized filaments; heating said oxidized filaments in an inert atmosphere of 300° to 900° C. under a tension to effect preliminary carbonization thereof; and further heating the preliminary carbonized filaments in an inert atmosphere of 1,000° to 1,500° C. to complete carbonization thereof.

2. A process for producing carbon fibers as claimed in claim 1, wherein said tension against said oxidized filaments in the preliminary carbonization step is within a range of 0.03 to 0.1 g/d, and said carbonization is effected under a tension of 0.2 to 0.8 g/d against said preliminarily carbonized filaments.

3. A process for producing carbon fibers as claimed in claim 1, wherein the comonomer of said acrylonitrile polymer is at least one member selected from the group consisting of acrylic acid, methacrylic acid, itaconic acid, and alkaline metal or ammonium salts and amide compound derivertives thereof.

4. A process for producing carbon fibers as claimed in claim 1, wherein said multistep drawing is effected in 3 to 6 steps of drawing baths of an organic solvent-water system maintained under successively elevated temperature conditions providing a temperature gradient ranging from about 30° C. to about 60° C.

5. A process for producing carbon fibers as claimed in claim 1, wherein the filament fineness of said drawn filaments is 0.1 to 0.8 d, and wherein the total number of filaments in a bundle is 500 to 30,000.

* * * * *